US006805507B2

(12) United States Patent
Tsai

(10) Patent No.: US 6,805,507 B2
(45) Date of Patent: Oct. 19, 2004

(54) KEYBOARD DEVICE

(76) Inventor: Huo-Lu Tsai, No. 188-1, Chung-Cheng Rd., Ta-Ya Shiang, Taichung Hsien (TW)

( * ) Notice: Subject to any disclaimer, the term of this patent is extended or adjusted under 35 U.S.C. 154(b) by 0 days.

(21) Appl. No.: 10/411,617

(22) Filed: Apr. 10, 2003

(65) Prior Publication Data

US 2004/0146330 A1 Jul. 29, 2004

(51) Int. Cl.[7] ..... B41J 5/08; H01H 13/14

(52) U.S. Cl. ..... 400/490; 400/489; 400/491; 400/491.2; 400/495; 400/496; 200/237; 200/341; 200/345

(58) Field of Search ..... 400/489, 490, 400/491.2, 495, 496; 200/237, 341, 345

(56) References Cited

U.S. PATENT DOCUMENTS 6,150,624 A * 11/2000 Yao ..... 200/344
6,179,497 B1 * 1/2001 Hu ..... 400/495
6,194,677 B1 * 2/2001 Li ..... 200/344
6,288,353 B1 * 9/2001 Chiang ..... 200/512

* cited by examiner

*Primary Examiner*—Daniel J. Colilla
(74) *Attorney, Agent, or Firm*—Ostrolenk, Faber, Gerb & Soffen, LLP

(57) ABSTRACT

In a keyboard device, a substrate is formed with multiple positioning members, each of which includes an upright first wall portion extending from one side of a punched hole, and a second wall portion connected to the first wall portion, extending toward another side of the punched hole and cooperating with the first wall portion to confine a positioning groove. Multiple key units are assembled on the substrate. Each key unit includes a base plate disposed on a membrane circuit, which is provided on the substrate. The base plate is formed with an opening to permit extension of an upright biasing member therethrough. Positioning blocks at opposite ends of the base plate engage correspondingly positioning grooves in the substrate. Each key unit further includes a foldable retaining member provided on the base plate for retaining a key cap on the base plate.

4 Claims, 7 Drawing Sheets

KEYBOARD DEVICE

BACKGROUND OF THE INVENTION

1. Field of the Invention

The invention relates to a keyboard device, more particularly to a keyboard device that can be produced through a simplified fabrication process and that can be easily assembled.

2. Description of the Related Art

FIG. 1 illustrates a conventional keyboard device that includes a substrate 16, a membrane circuit 15, and a plurality of key units (only one is shown). The substrate 16 is subjected to first and second punching operations (see FIG. 2) so as to form the substrate 16 with a plurality of rectangular punched holes 160, and a plurality of positioning lugs 161. Each of the positioning lugs 161 extends upwardly from one side of a corresponding one of the punched holes 160, and is formed with a positioning hole 162 therethrough. The membrane circuit 15 is provided on the substrate 16 and is formed with a plurality of apertures 151 registered with the punched holes 160 in the substrate 16 to permit upward extension of the positioning lugs 161. Each key unit includes an upright biasing member 14 mounted on a film layer 141 that is provided on the membrane circuit 15 and that is formed with a plurality of through holes 142 registered with the apertures 151 in the membrane circuit 15 to permit upward extension of the positioning lugs 161, a base plate 13 disposed on the film layer 141 and formed with an opening 133 to permit upward extension of the biasing member 14 and opposite positioning protrusions 132 on opposite ends 131 to engage the corresponding positioning holes 162 such that the base plate 13 is positioned on the substrate 16, a key cap 11 disposed above and abutting against the biasing member 14, and a foldable retaining member 12 provided between the base plate 13 and the key cap 11 for retaining the key cap 11 on the base plate 13.

The following are some of the drawbacks of the conventional keyboard device:

1. The substrate 16 must be subjected to the first and second punching operations such that the fabrication process for the conventional keyboard device is relatively complicated. Moreover, referring to FIG. 2, during the first punching operation, black areas (A, B) have to be removed from the substrate 16 such that punched scraps generated during the first punching operation result in waste of material.

2. Since the structural strength of each positioning lug 161 is weakened during the first punching operation, deformation of the positioning lugs 161 resulting from the second punching operation may occur. Consequently, accurate engagement between the positioning lugs 161 on the substrate 16 and the positioning protrusions 132 of the base plate 13 cannot be ensured.

SUMMARY OF THE INVENTION

Therefore, the object of the present invention is to provide a keyboard device that can be produced through a simplified fabrication process and that can be easily assembled.

According to the present invention, a keyboard device comprises:

a substrate subjected to a single punching operation so as to form the substrate with a plurality of punched holes, each of which has a first side and a plurality of positioning members, each of which includes an upright first wall portion that extends from the first side of a corresponding one of the punched holes, and a second wall portion that is connected to the first wall portion and that extends parallel to the substrate such that the first and second wall portions cooperate to confine a positioning groove;

a membrane circuit provided on the substrate and formed with a plurality of through holes registered with the punched holes in the substrate, respectively, the through holes permitting the positioning members of the substrate to extend upwardly therethrough, the membrane circuit being provided with a plurality of electrical contacts; and a plurality of key units disposed on the membrane circuit and assembled on the substrate, each of the key units including an upright biasing member supported on the membrane circuit and having an actuator registered with a corresponding one of the electrical contacts, a base plate disposed on the membrane circuit and formed with an opening to permit extension of the biasing member therethrough, the base plate having opposite ends, each of which is formed with an outwardly extending positioning block engaged in the positioning groove confined by a corresponding one of the positioning members of the substrate such that the base plate is positioned on the substrate, a key cap disposed above the base plate, and a foldable retaining member provided between the base plate and the key cap for retaining the key cap on the base plate such that the key cap is movable toward and away from the base plate, the biasing member providing a biasing force for moving the key cap away from the base plate.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 3:
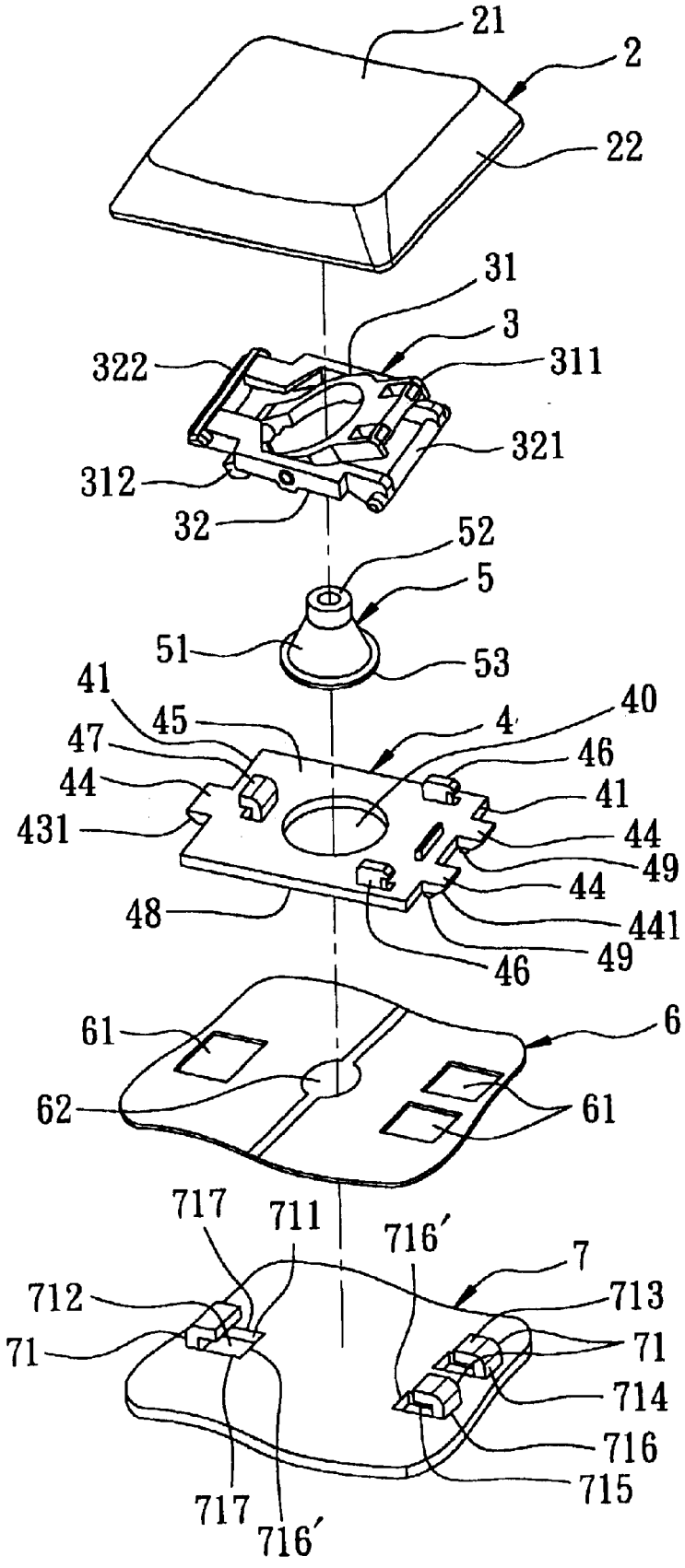
FIG. 3 is fragmentary exploded perspective view showing the first preferred embodiment of a keyboard device according to this invention.
Figure 4:
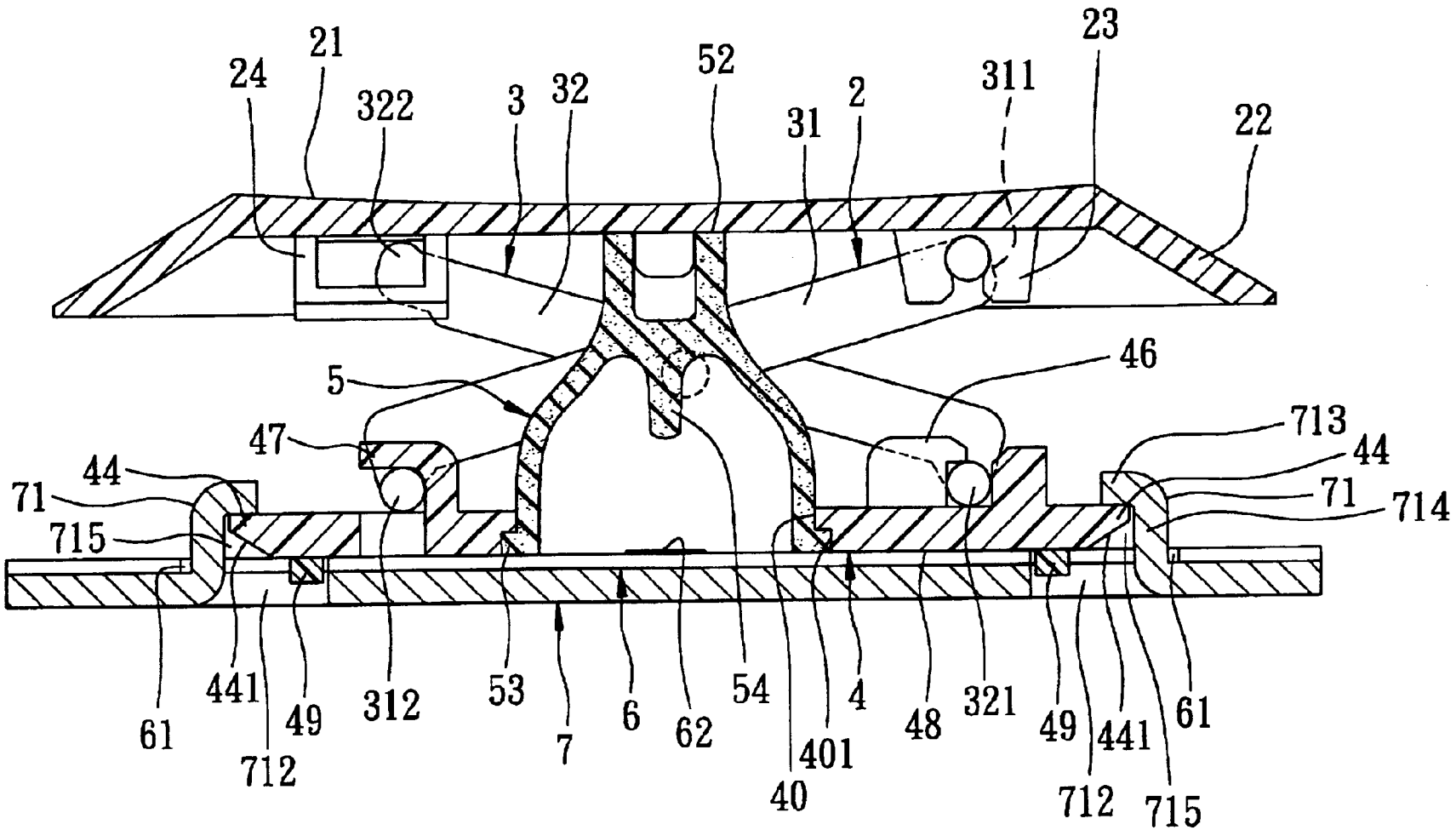
FIG. 4 is a fragmentary schematic sectional view showing the first preferred embodiment.

Referring to FIGS. 3 and 4, the first preferred embodiment of a keyboard device according to the first present invention is shown to include a substrate 7, a membrane circuit 6, and a plurality of key units (only one is shown).

Figure 5:
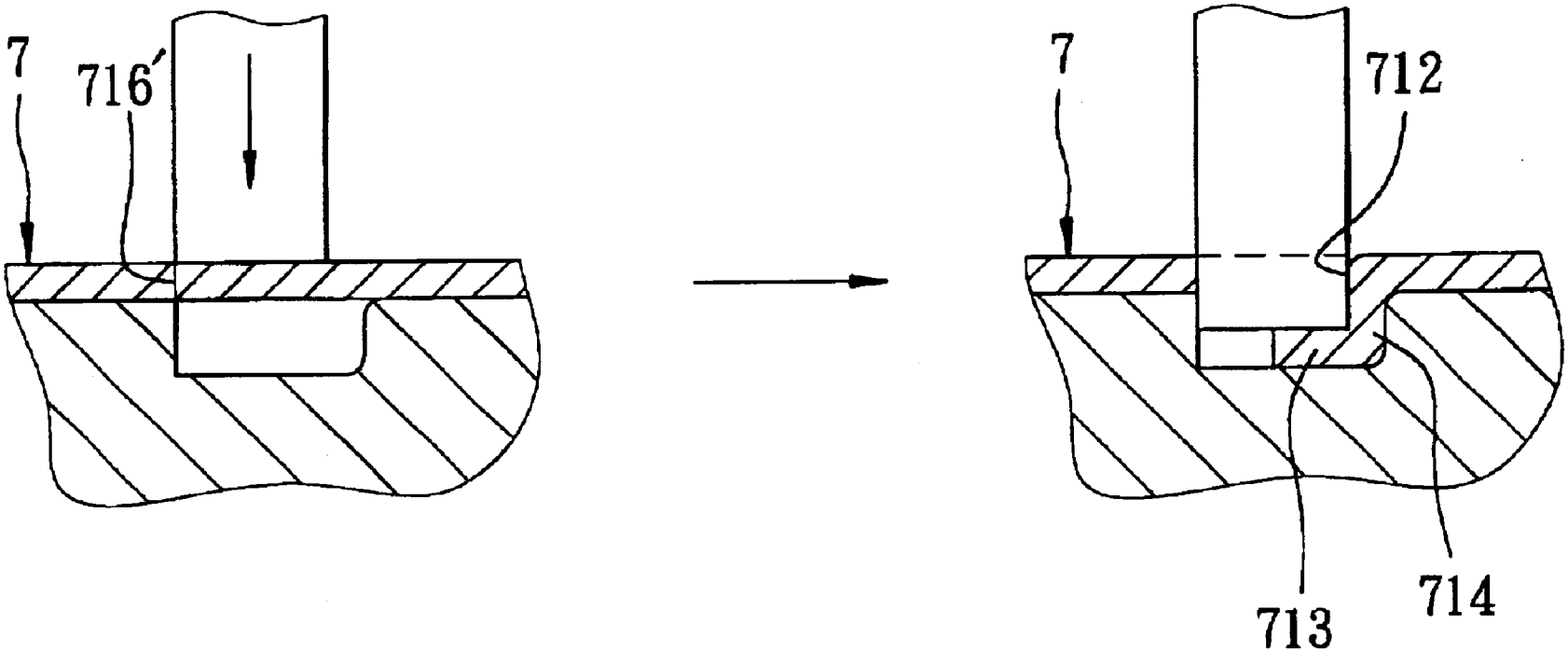
FIG. 5 is a schematic view illustrating the fabrication process of a substrate of the first preferred embodiment.

The substrate 7 is subjected to a single punching operation, as shown in FIG. 5, so as to form the substrate 7 with a plurality of rectangular punched holes 712, each of which has opposite first and second sides 716, 716' and opposite third and fourth sides 717, and a plurality of inverted L-shaped positioning members 71. Each of the positioning members 71 includes an upright first wall portion 714 that extends from the first side 716 of a corresponding one of the punched holes 712, and a secondw all portion 713 that is connected to the first wall portion 714 and that extends parallel to the substrate 7 and toward the second side 716' of the corresponding one of the punched holes 712 such that the first and second wall portions 714, 713 cooperate to confine a positioning groove 715 (see FIG. 3).

The membrane circuit 6 is provided on the substrate 7 and is formed with a plurality of through holes 61 registered with the punched holes 712 in the substrate 7, respectively. The through holes 61 permit the positioning members 71 of the substrate 7 to extend upwardly therethrough. The membrane circuit 6 is provided with a plurality of electrical contacts 62 (only one is shown).

The key units are disposed on the membrane circuit 6 and are assembled on the substrate 7. Each of the key units includes an upright biasing member 5, a base plate 4, a key cap 2 and a foldable retaining member 3.

The biasing member 5 is supported on the membrane circuit 6, and has a closed upper portion 52, and an open lower portion 51 that abuts against the membrane circuit 6. The upper portion 52 has a bottom surface provided with an actuator 54 that is registered with a corresponding one of the electrical contacts 62, as shown in FIG. 4. The lower portion 51 is formed with a radially extending engaging ring 53.

The base plate 4 is disposed on the membrane circuit 6 and is formed with an opening 40, which has a diameter less than that of the engaging ring 53, to permit extension of the biasing member 5 therethrough and engagement between the engaging ring 53 and an annular engaging groove 401 formed in the opening 40. In this embodiment, the base plate 4 has opposite ends 41, one of which is formed with an outwardly extending positioning block 44 engaged in the positioning groove 715 confined by a corresponding one of the positioning members 71 of the substrate 7, and the other one of which is formed with two outwardly extending positioning blocks 44 engaged in the positioning grooves 715 confined by corresponding ones of the positioning members 71 of the substrate 7, respectively, such that the base plate 4 is positioned on the substrate 7. In this embodiment, each positioning block 44 is formed with a positioning post 49 extending downwardly and into a corresponding one of the punched holes 712 in the substrate 7. Each positioning block 44, which is made of plastic, is resilient and has a lower beveled surface 441 so as to permit downward movement of the positioning block 44 past the second wall portion 713 and into the positioning groove 715 of the corresponding one of the positioning members 71. As such, by sliding of each positioning block 44 from one of the third and fourth sides 717 of the corresponding one of the punched holes 712 and into the positioning groove 715 of the corresponding one of the positioning members 71 or by applying a downward force on the base plate 4 to force each positioning block 44 to engage the positioning groove 715 of the corresponding one of the positioning members 71, the base plate 4 can be easily positioned on the substrate 7.

The key cap 2 is disposed above and abuts against the biasing member 5 of the biasing member 5.

The retaining member 3 is provided between the base plate 4 and the key cap 2 for retaining the key cap 2 on the base plate 4 such that the key cap 2 is movable toward the base plate 4 against biasing action of the biasing member 5. In this embodiment, the retaining member 3 has first and second support frames 31, 32 connected pivotally to each other. The first support frame 31 has a first pivot end 311 connected pivotally to a pivot lug 23 on the key cap 2 (see FIG. 4), and a first slide end 312 opposite to the first pivot end 311 and engaging slidably a slide retainer 47 on the base plate 4. The second support frame 32 has a second pivot end 321 connected pivotally to a pair of pivot retainers 46 on the base plate 4, and a second slide end 322 opposite to the second pivot end 321 and engaging slidably a slide retainer unit 24 on the key cap 2 (see FIG. 4).

Since the particular engagement among the key cap 2, the base plate 4 and the retaining member 3 is known in the art, a detailed description of the same is dispensed with herein for the sake of brevity. Moreover, since operation of the keyboard device of this invention is the same as that of the prior art, a detailed description thereof is also dispensed with herein.

Figure 6:
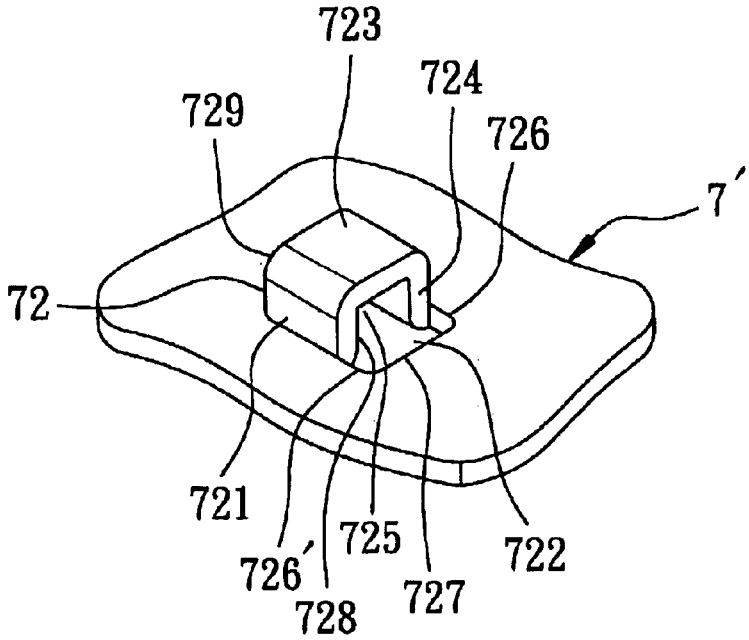
FIG. 6 is a fragmentary perspective view showing a substrate of the second preferred embodiment of a keyboard device according to this invention.
Figure 7:
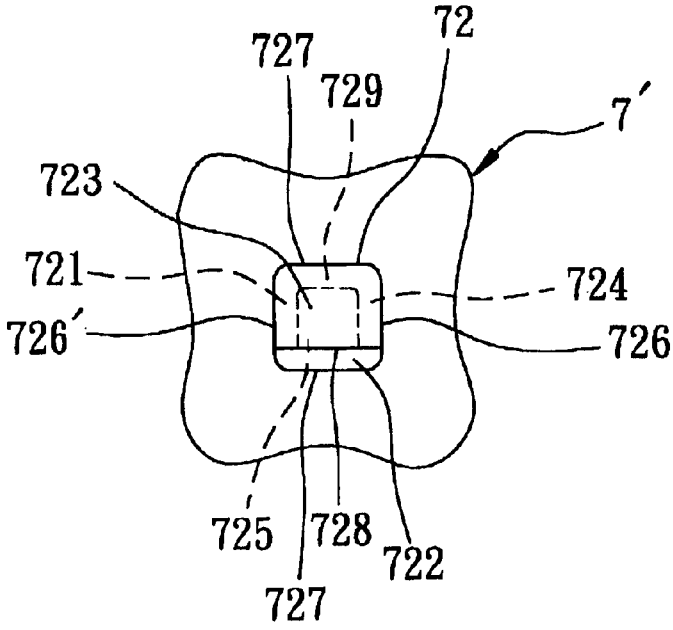
FIG. 7 is a schematic top view of FIG. 6.

FIGS. 6 and 7 illustrate the second preferred embodiment of a keyboard device according to this invention, which is a modification of the first preferred embodiment. Unlike the previous embodiment, each positioning member 72, which is formed on the substrate 7' during a single punching operation, further includes an upright third wall portion 721 extending from the second side 726' of the corresponding one of the punched holes 722 and connected to the second wall portion 723 so as to form an opening 728 at one of the third and fourth sides 727 of the corresponding one of the punched holes 722, and an upright fourth wall 729 extending from the other one of the third and fourth sides 727 of the corresponding one of the punched holes 722 and connected to the first, second and third wall portions 724, 723, 721. The first, second and third wall portions 724, 723, 721 cooperatively confine the positioning groove 725.

Figure 8:
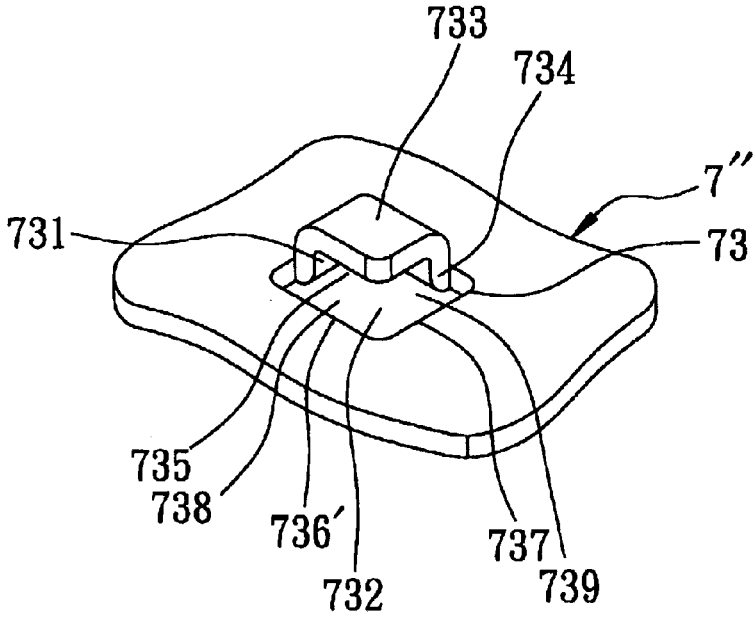
FIG. 8 is a fragmentary perspective view showing a substrate of the third preferred embodiment of a keyboard device according to this invention.
Figure 9:
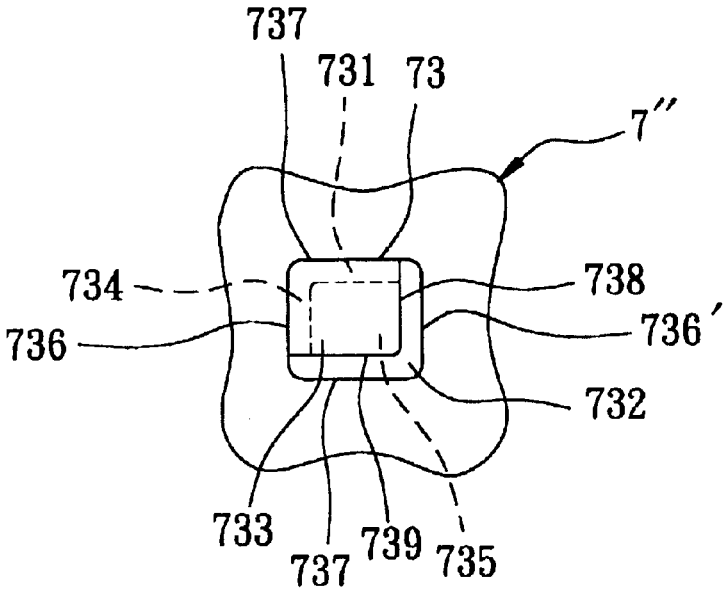
FIG. 9 is a schematic top view of FIG. 8.

FIGS. 8 and 9 illustrate the third preferred embodiment of a keyboard device according to this invention, which is a modification of the first preferred embodiment. Unlike the previous embodiments, each positioning member 73, which is formed on the substrate 7" during a single punching operation, further includes an upright third wall portion 731 extending from one of the third and fourth sides 737 of the corresponding one of the punched holes 732 and connected to the first and second wall portions 734, 733 so as to form a first opening 738 at the second side 736' of the corresponding one of the punched holes 732, and a second opening 739 at the other one of the third and fourth sides 737 of the corresponding one of the punched holes 732. The first, second and third wall portions 734, 733, 731 cooperatively confine the positioning groove 735.

The following are some of the advantages attributed to the keyboard device of the present invention:

1. Since the positioning members 71, 72, 73 are formed during a single punching operation, the fabrication process for the keyboard device of this invention can be simplified. Moreover, punched scrap generated during the punching operation can be reduced to a minimum.

2. Since the positioning members 71, 72, 73 are formed integrally and have no through hole formed therein, deformation of the positioning members 71, 72, 73 resulting from the punching operation can be avoided such that accurate engagement between the positioning members 71, 72, 73 on the substrate 7, 7', 7" and the positioning blocks 44 of the base plate 4 can be ensured.

3. The base plate 4 in the first preferred embodiment can be positioned on the substrate in a sliding or pushing way, thereby resulting in convenient assembly.

Figure 1:
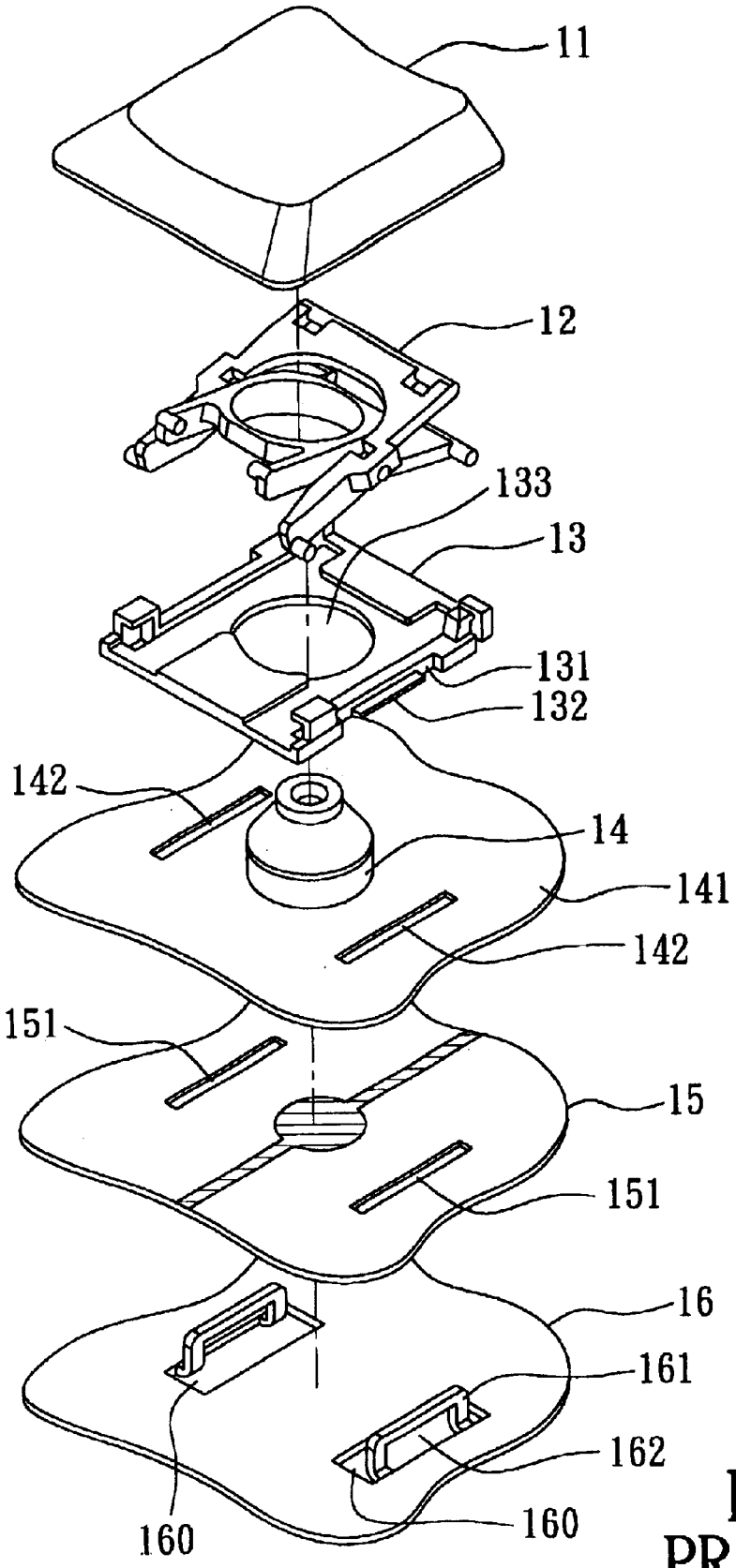
FIG. 1 PRIOR ART
FIG. 1 is a fragmentary exploded perspective view of a conventional keyboard device.
Figure 2:
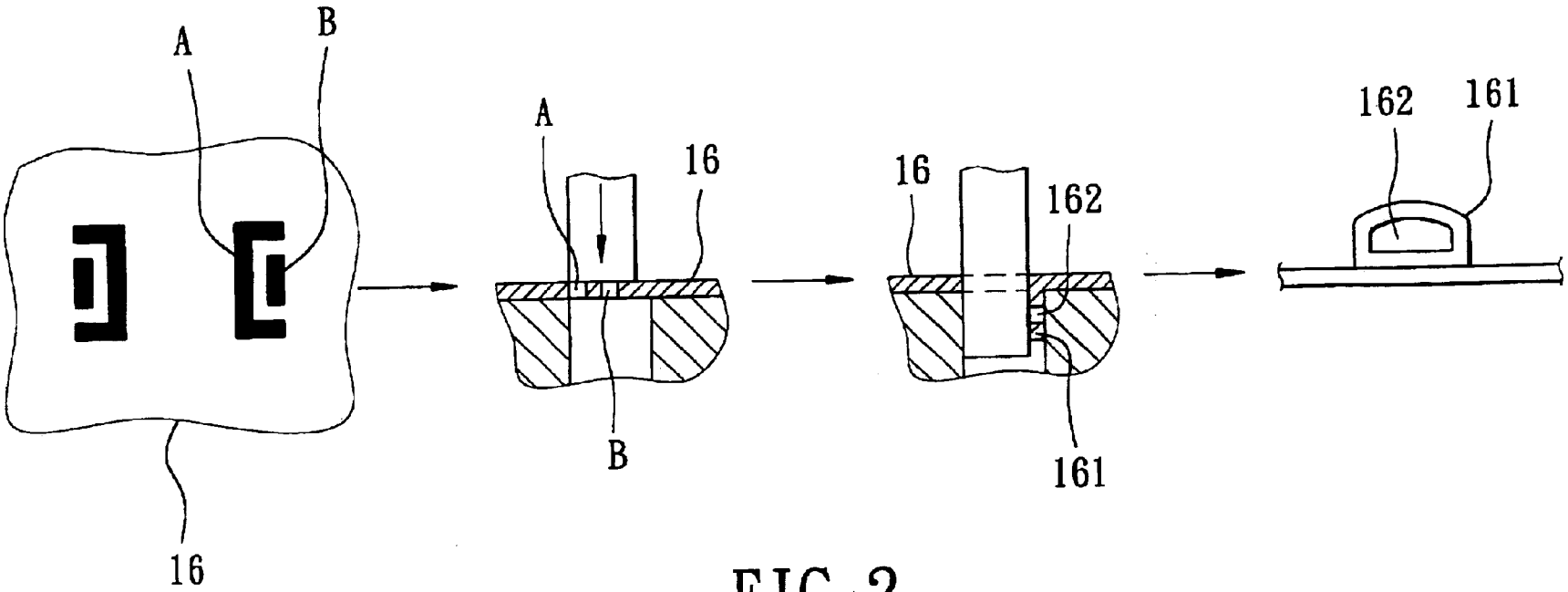
FIG. 2 PRIOR ART
FIG. 2 is a schematic view illustrating the fabrication process of a substrate of the conventional keyboard device.

In the embodiment of FIG. 1, the biasing member 5 abuts directly against the key cap 2. However, in another embodiment, the biasing member 5 provides a biasing force that acts directly on the retaining member 3 to achieve the same result.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A keyboard device comprising:

a substrate subjected to a single punching operation so as to form said substrate with a plurality of punched holes, each of which has a first side and a plurality of positioning members, each of which includes an upright first wall portion that extends from said first side of a corresponding one of said punched holes, and a second wall portion that is connected to said first wall portion and that extends parallel to said substrate such that said first and second wall portions cooperate to confine a positioning groove;

a membrane circuit provided on said substrate and formed with a plurality of through holes registered with said punched holes in said substrate, respectively, said through holes permitting said positioning members of said substrate to extend upwardly therethrough, said membrane circuit being provided with a plurality of electrical contacts; and a plurality of key units disposed on said membrane circuit and assembled on said substrate, each of said key units including an upright biasing member supported on said membrane circuit and having an actuator registered with a corresponding one of said electrical contacts, a base plate disposed on said membrane circuit and formed with an opening to permit extension of said biasing member therethrough, said base plate having opposite ends, each of which is formed with an outwardly extending positioning block engaged in said positioning groove confined by a corresponding one of said positioning members of said substrate such that said base plate is positioned on said substrate, said positioning block is formed with a positioning post extending downwardly and into a corresponding one of said punched holes in said substrate for positioning said base plate on said substrates;

a key cap disposed above said base plate, and a foldable retaining member provided between said base plate and said key cap for retaining said key can on said base plate such that said key cap is movable toward and away from said base plate, said biasing member providing a biasing force for moving said key cap away from said base plate.

2. The keyboard device as claimed in claim 1, wherein said positioning block is resilient and has a lower beveled surface so as to permit downward movement of said positioning block past said second wall portion and into said positioning groove of the corresponding one of said positioning members.

3. A keyboard device comprising:

a substrate subjected to a single punching operation so as to form said substrate with a plurality of punched holes, each of which has a first side and a plurality of positioning members, each of which includes an upright first wall portion that extends from said first side of a corresponding one of said punched holes, and a second wall portion that is connected to said first wall portion and that extends parallel to said substrate such that said first and second wall portions cooperate to confine a positioning groove;

a membrane circuit provided on said substrate and formed with a plurality of through holes registered with said punched holes in said substrate, respectively, said through holes permitting said positioning members of said substrate to extend upwardly therethrough, said membrane circuit being provided with a plurality of electrical contacts; and a plurality of key units disposed on said membrane circuit and assembled on said substrate, each of said key units including an upright biasing member supported on said membrane circuit and having an actuator registered with a corresponding one of said electrical contacts, a base plate disposed on said membrane circuit and formed with an opening to permit extension of said biasing member therethrough, said base plate having opposite ends, each of which is formed with an outwardly extending positioning block engaged in said positioning groove confined by a corresponding one of said positioning members of said substrate such that said base plate is positioned on said substrate;

a key cap disposed above said base plate, and a foldable retaining member provided between said base plate and said key cap for retaining said key cap on said base plate such that said key cap is movable toward and away from said base plate, said biasing member providing a biasing force for moving said key cap away from said base plate;

each of said punched holes is rectangular and further has a second side opposite to said first side, and opposite third and fourth sides, each of said positioning members further including an upright third wall portion extending from said second side of the corresponding one of said punched holes and connected to said second wall portion so as to form an opening at one of said third and fourth sides of the corresponding one of said punched holes, said first, second and third wall portion cooperatively confining said positioning groove.

4. A keyboard device comprising:

a substrate subjected to a single punching operation so as to form said substrate with a plurality of punched holes, each of which has a first side and a plurality of positioning members, each of which includes an upright first wall portion that extends from said first side of a corresponding one of said punched holes, and a second wall portion that is connected to said first wall portion and that extends parallel to said substrate such that said first and second wall portions cooperate to confine a positioning groove;

a membrane circuit provided on said substrate and formed with a plurality of through holes registered with said punched holes in said substrate, respectively, said through holes permitting said positioning members of said substrate to extend upwardly therethrough, said membrane circuit being provided with a plurality of electrical contacts; and a plurality of key units disposed on said membrane circuit and assembled on said substrate, each of said key units including an upright biasing member supported on said membrane circuit and having an actuator registered with a corresponding one of said electrical contacts, a base plate disposed on said membrane circuit and formed with an opening to permit extension of said biasing member therethrough, said base plate having opposite ends, each of which is formed with an outwardly extending positioning block engaged in said positioning groove confined by a corresponding one of said positioning members of said substrate such that said base plate is positioned on said substrate;

a key cap disposed above said base plate, and a foldable retaining member provided between said base plate and said key cap for retaining said key cap on said base plate such that said key cap is movable toward and away from said base plate, said biasing member providing a biasing force for moving said key cap away from said base plate;

each of said punched holes is rectangular and further has a second side opposite to said first side, and opposite third and fourth sides, each of said positioning members further including an upright third wall portion extending from one of said third and fourth sides of the corresponding one of said punched holes and connected to said first and second wall portions so as to form a first opening at said second side of the corresponding one of said punched holes, and a second opening at the other one of said third and fourth sides of the corresponding one of said punched holes, said first, second and third wall portions cooperatively confining said positioning groove.

* * * * *